US008164238B2

(12) United States Patent
Lee

(10) Patent No.: US 8,164,238 B2
(45) Date of Patent: Apr. 24, 2012

(54) LIGHT EMITTING DIODE (LED) LAMP

(75) Inventor: Ke-chin Lee, Taipei (TW)

(73) Assignee: Zhongshan Weiqiang Technology Co., Ltd., Zhongshan (CN)

( * ) Notice: Subject to any disclaimer, the term of this patent is extended or adjusted under 35 U.S.C. 154(b) by 0 days.

(21) Appl. No.: 13/021,875

(22) Filed: Feb. 7, 2011

(65) Prior Publication Data

US 2011/0221324 A1 Sep. 15, 2011

(30) Foreign Application Priority Data

Mar. 13, 2010 (CN) ..... 2010 1 0125449

(51) Int. Cl.
*H01J 61/52* (2006.01)
*F21V 29/02* (2006.01)

(52) U.S. Cl. ..... 313/46; 313/512; 362/800; 362/294; 362/373; 362/126; 362/345

(58) Field of Classification Search ..... None
See application file for complete search history.

(56) References Cited

U.S. PATENT DOCUMENTS

| | | | | |
|---|---|---|---|---|
| 2006/0126338 | A1* | 6/2006 | Mighetto | 362/294 |
| 2009/0059594 | A1* | 3/2009 | Lin | 362/294 |
| 2009/0273924 | A1* | 11/2009 | Chiang | 362/241 |
| 2010/0314984 | A1 | 12/2010 | Lee | |
| 2011/0050100 | A1* | 3/2011 | Bailey et al. | 315/35 |

* cited by examiner

*Primary Examiner* — Ashok Patel
(74) *Attorney, Agent, or Firm* — Rissman, Hendricks & Oliverio, LLP

(57) ABSTRACT

A light emitting diode (LED) lamp includes a standardized connector; an LED module; a heat dissipating module; an angle adjusting ring; and an isolating ring. The LED module is electrically connected to the standardized connector and includes a circuit board and at least one LED unit electrically connected to the circuit board. The heat dissipating module is for preventing the LED module from overheating and includes at least one heat pipe on which the LED unit is disposed, a rear heat dissipating shield, a piston module, a transmission module, a heat dissipating fan, and a convection fan. The angle adjusting ring is disposed between the LED module and the standardized connector for rotating the LED module so as to change a light emitting direction of the LED module. The isolating ring is used to avoid the electrical connection of the angle adjusting ring and the standardized connector.

20 Claims, 2 Drawing Sheets

LIGHT EMITTING DIODE (LED) LAMP

CROSS-REFERENCE TO RELATED APPLICATION

This application claims priority to Chinese Patent No. 201010125449.2, filed on Mar. 13, 2010, under the title "AN LED LAMP," the contents of which are incorporated by reference herein.

TECHNICAL FIELD

The present disclosure relates in general to a lamp, and more particularly to a light emitting diode (LED) lamp which can directly replace the conventional lamps used in street lighting.

BACKGROUND

At present most of the lamps used in street lighting on the market are conventional mercury vapor lamps, which are fitted in the sockets of the street lights and illuminate streets. It is known that these conventional mercury lamps have a shorter lifespan less than 3,000 hours. Besides, they still have various other disadvantages, such as big energy consumption, high operation cost, etc. It is obvious that the conventional mercury vapor lamps have no longer been able to satisfy the requirements of energy conservation and pollution reduction in the modern society.

On the other hand, today the rapid developing light emitting diode (LED) illumination technology has provided a reasonable alternative for street lighting, which replaces the widely used mercury vapor lamps with LED lamps for higher energy utilization efficiency. However, the existing street lights have been developed for more than a century; a firmed industrial standard has been formed. For example, the socket widely used in street lights for receiving the lamp is a metal cap-shaped connector named E40. For replacing the conventional mercury vapor lamps with LED lamps, the best plan is to connect LED lamps directly to the sockets of the existing street lights without any modifications. However, this cannot be realized now because the current LED lamps have not had the specific connectors (e.g. E40 metal cap) as the conventional lamps. Moreover, most of the LED lamps tend to have a compact structure to reduce the weight and volume. This structure directly results in a smaller interior space, thus in such a small room, the ability of heat-dissipating will be significantly weakened, and consequently becomes an important problem studied by people.

SUMMARY

One purpose of the present invention is to provide an LED lamp with a standardized connector, which can be directly used with the conventional lamp sockets in the existing street lights.

Another purpose of the present invention is to provide an LED lamp with better heat dissipating mechanism, preventing the LED lamp from overheating.

Another purpose of the present invention is to provide an LED lamp with an emitting angle adjusting function.

According to the invention, in brief, the LED lamp comprises a standardized connector, an LED module, a heat-dissipating module, an angle adjusting ring, and an isolating ring. The LED module is electrically connected to the standardized connector and comprises a circuit board, wherein the circuit board is electrically connected to at least one LED unit. The heat dissipating module comprises a rear heat dissipating shield and at least one heat pipe, the heat pipe has a flat segment and a non-flat segment, wherein the flat segment is in contact with the LED unit and the non-flat segment connects to the rear heat dissipating shield. The heat dissipating module further comprises a piston module disposed between the heat pipe and rear heat dissipating shield, a heat dissipating fan disposed in front of the LED lamp, and a transmission module connecting the piston module and the heat dissipating fan, wherein the piston module is powered by the thermal energy generated by the LED module and actuates the heat dissipating fan through the transmission module.

As a further modification to the above invention, the circuit board is located on the back side of the flat segment of the heat pipe, and the piston module comprises a piston cylinder mounted on the back side of the circuit board, a piston in the piston cylinder, and a piston rod attached to the piston, wherein the piston rod is connected to the heat-dissipating fan by means of the transmission module.

As a further modification to the above invention, the circuit board has a through hole, the heat dissipating module further comprises a convection fan which is placed in the through hole and connected to the piston rod by means of the transmission module.

The LED lamp further comprises an angle adjusting ring disposed between the LED module and the standardized connector for rotating the LED module so as to change a light emitting direction of the at least one LED unit, wherein the angle adjusting ring comprises at least one locking element for fixing the LED module on the connector after rotated to a required direction.

The LED lamp further comprises an isolating ring disposed between the angle adjusting ring 4 and the standardized connector 1 for avoiding the electrical connection of the angle adjusting ring and the standardized connector.

DETAILED DESCRIPTION

Figure 1:
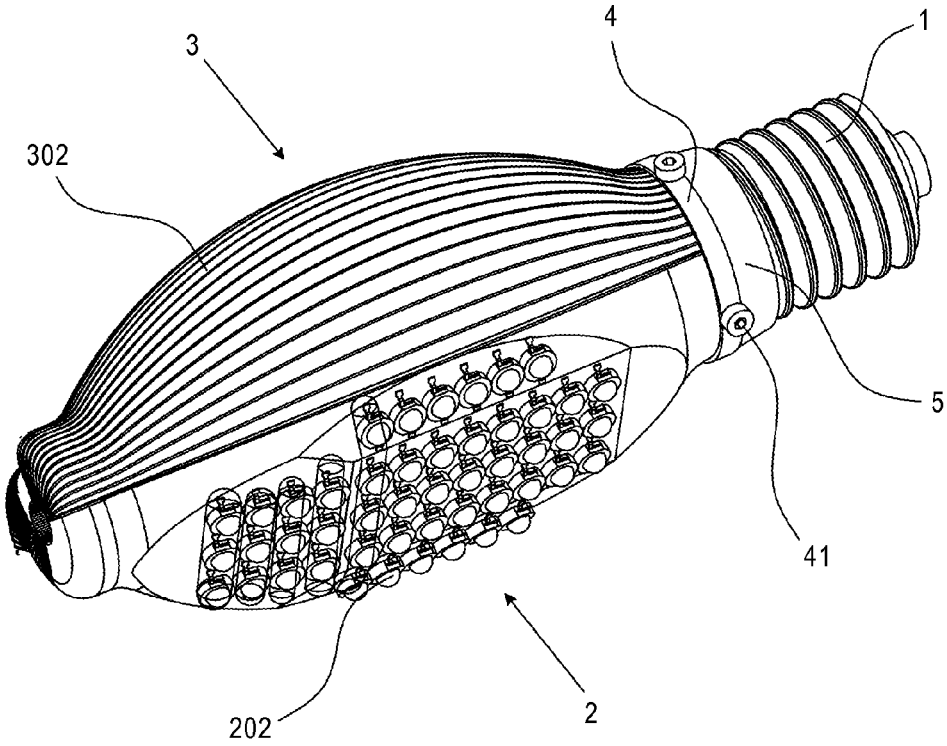
FIG. 1 is a schematic diagram illustrating an LED lamp according to an embodiment of the present invention.
Figure 2:
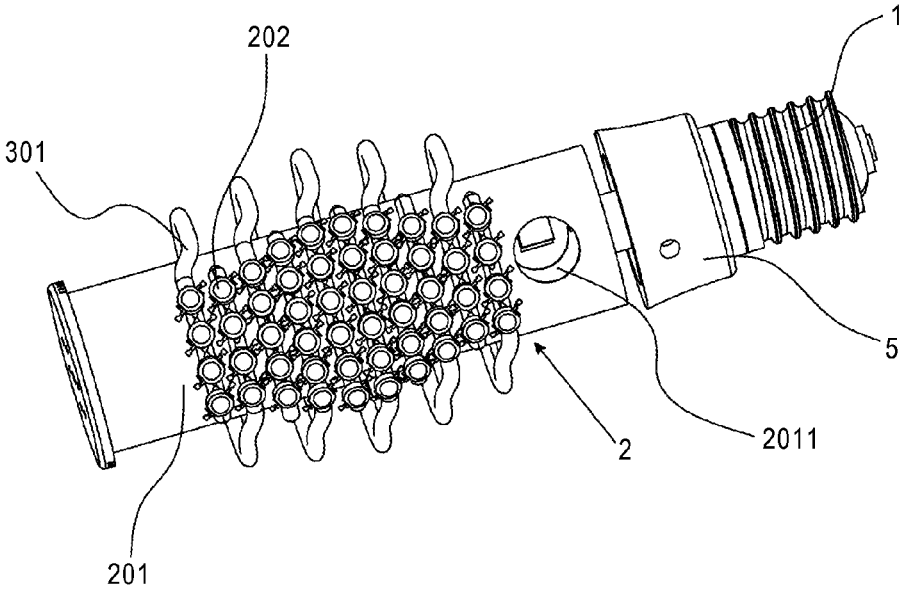
FIG. 2 is a schematic diagram illustrating the inside structure of FIG. 1.

In reference to FIG. 1 to FIG. 4, an LED lamp provided by the present invention comprises a standardized connector 1, an LED module 2 and a heat-dissipating module 3.

In the first, the standardized connector 1 can be any general types of lamp connector matching the sockets in the existing street lights, such as E40 connector, E27 connector or other threaded connectors which can be screwed into the sockets of street light and fixed therein.

The LED module 2 is electrically connected to the standardized connector 1 and works when powered, it further comprises a circuit board 201 for carrying various electronic components, wherein at least one LED unit 202 is electrically connected to the circuit board 201 to ensure the LED lamp functions normally.

Figure 3:
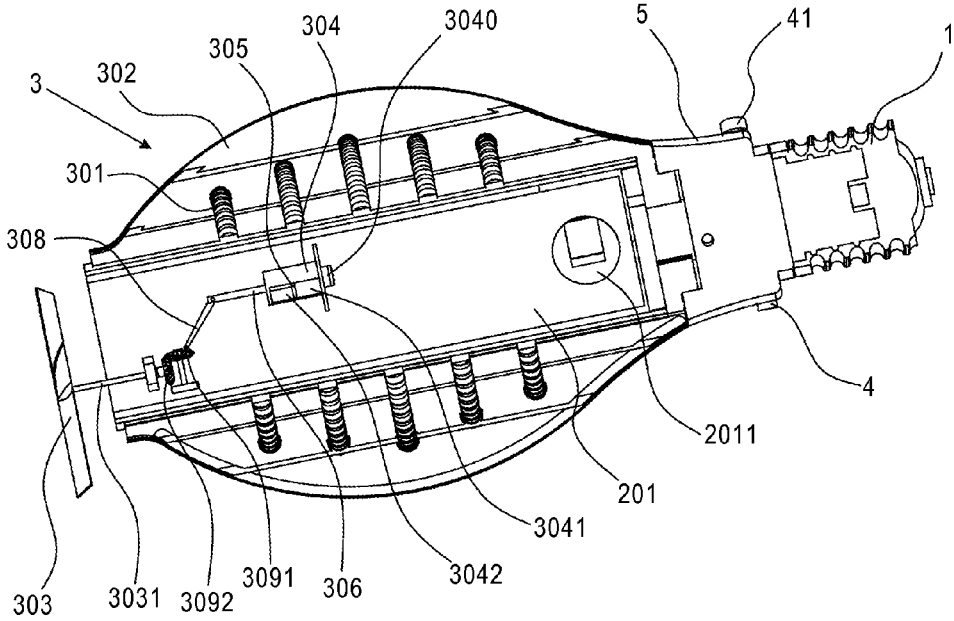
FIG. 3 is a schematic diagram illustrating the inside structure of an LED lamp according to the first embodiment of the present invention.

The heat-dissipating device 3 is designed to dissipate the heat generated by LED module 2 for preventing the LED module 2 from overheating, in the first embodiment shown in FIG. 3, it comprises at least one heat pipe 301 for better heat conduction effect. The heat pipe 301 has a flat segment and a non-flat segment, wherein the flat segment is in contact with the LED unit 202. This arrangement ensures that the heat generated by the LED unit 202 can be transferred to the flat segment of the heat pipe 301 and then to the non-flat segment of the heat pipe 301 quickly and effectively.

The heat-dissipating device 3 further comprises a heat-dissipating rear shield 302, which can be an aluminum heat sink with a plurality of fins. The heat-dissipating rear shield 302 connects to the non-flat segment of the heat pipe 301. In this embodiment the heat pipe 302 penetrates the fins of the heat-dissipating rear shield 302, to dissipate the heat transferred from the flat segment of the heat pipe 301 to the air surrounding the fins.

A piston module is disposed between the heat pipe 301 and the heat-dissipating rear shield 302. It is driven by the thermal energy generated by the LED module 2, providing power for fans (heat-dissipating fan 303 and/or convection fan 307).

A heat-dissipating fan 303 is disposed in front of the LED lamp and connected to the piston module. The heat-dissipating fan 303 is actuated by the piston module for directing hot air from the internal cavity out to the exterior of the LED lamp.

As a preferred embodiment, wherein the circuit board 201 is located on the back side of the flat segment of the heat pipe 301, and the piston module comprises a piston cylinder 304 disposed on the back side of the circuit board 201, a piston 305 mounted inside the piston cylinder 304, and a piston rod 306 attached to the piston 305, wherein the piston rod 305 is further connected to the heat-dissipating fan 303 by means of a transmission module to form a complete power link gear, which is placed between the circuit board 201 and the heat-dissipating rear shield 302.

The use of the standardized connector 1 in the present invention ensures that the LED lamp can be directly fitted into the conventional street light bases as a common light bulb, for example, people can directly use the LED lamp disclosed by the present invention to replace the mercury lamp without any difficulties. Therefore, it avoids spending additional costs in adapting the existing widely used street lights to the rising LED technology. The use of the LED lamp disclosed in the present invention not only greatly extends the lifespan of the street lights, but also satisfies the requirements of energy conservation and pollution reduction.

Figure 4:
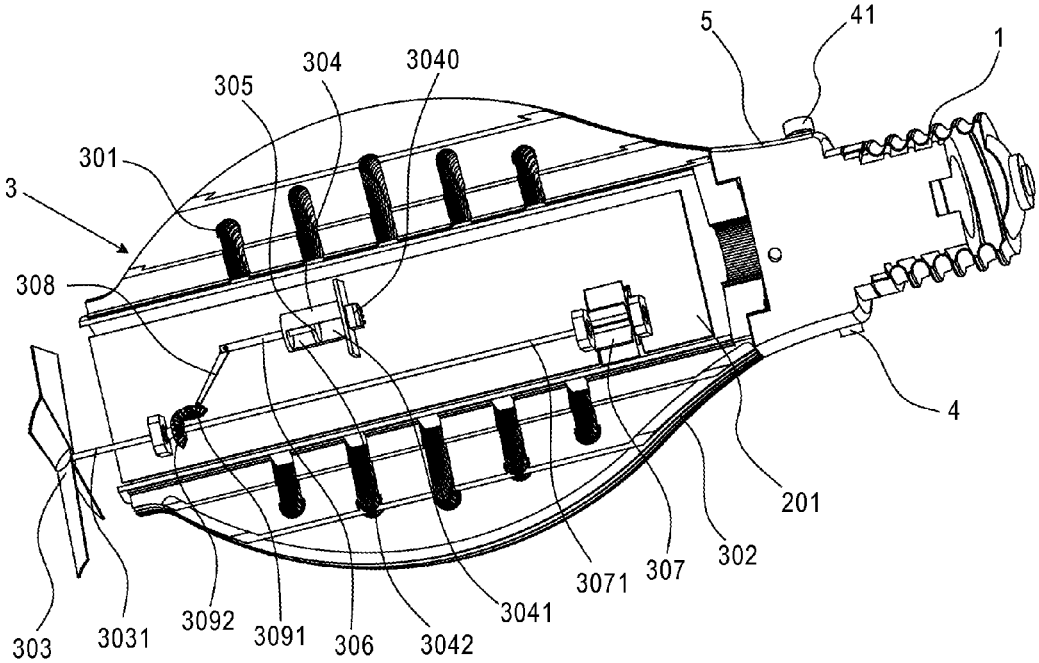
FIG. 4 is a schematic diagram illustrating the inside structure of an LED lamp according to the second embodiment of the present invention.

Additionally, in the second embodiment shown in FIG. 4, the circuit board 201 preferably has a through hole 2011 to allow the hot air to go through the LED unit 202. To facilitate this air flow, the heat dissipating module further comprises a convection fan 307 placed in the through hole 2011, which is also connected to the piston rod 306 by means of the transmission module. Therefore, the operation of the convection fan 307 can enhance the air convection in both front and back side of the circuit board 201 for better heat dissipation.

In the above-mentioned embodiments, the piston module is powered by the hot air. The back side of the piston cylinder 304 has a heat conduction portion 3040, such as a power transistor or other components in which the heat is difficult to dissipate. The heat conduction portion 3040 is able to transfer the heat generated by the LED module 2 to the piston cylinder 304 efficiently. Moreover, the interior of the piston cylinder 304 is separated into a rear hot chamber 3041 and a front cool chamber 3042 by the piston 305, wherein the hot chamber 3041 connects the heat conduction portion 3040. The heat generated by the LED lamp is absorbed by the heat conduction portion 3040 and then transferred to the air in the hot chamber 3041. Because of the thermal expansion, the air in the hot chamber 3041 expands by heat and pushes the piston 305 to move forward.

Furthermore, here the transmission module comprises a first conical gear 3091, a second conical gear 3092 and a connecting rod 308. The piston cylinder 304 is mounted longitudinally and oriented forwardly with respect to the direction of the LED lamp, the front end of the piston rod 306 is moveably connected to the first conical gear 3091 mounted horizontally by the connecting rod 308, the first conical gear 3091 engages with the second conical gear 3092 mounted perpendicularly for transmitting motion. This arrangement can convert the straight forward motion of the piston 305 to the rotational motion of the second conical gear 3092.

The heat dissipating fan 303 comprises a shaft of the heat-dissipating fan 3031 attached on the back side thereof. The shaft of the heat-dissipating fan 3031 extends into LED lamp and connects to the second conical gear 3092 so that the rotation motion of the second conical gear 3092 can be transmitted to the heat-dissipating fan 303. The rotation of the heat-dissipating fan 303 blows the cold air in the exterior of the LED lamp into the interior of the LED lamp. When the cold air come into contact with the heat conduction portion 3040, the heat is transmitted from the air in the hot chamber 3041 to the cold air and as a result the heat chamber 3041 shrinks, thus the piston 305 moves back to original position and pulls the piston rod 306 back. In the same way, the straight backward motion of the piston 305 is converted into the rotational motion of the heat-dissipating fan 303. Therefore, the straight reciprocated motion of the piston 305 can be converted into the continuously rotational motion of the heat-dissipating fan 303 by the transmission gear pair (3091, 3092) and the connecting rod 308, forming a power cycle without any additional power sources.

Based on the above-mentioned configuration, the heat-dissipating module further comprises a convection fan 307 in the second embodiment shown in FIG. 4. Similarly, the convection fan 307 is also connected to the second conical gear 3092 by a shaft of the convection fan 3071.

Additionally, in a preferred embodiment of the present invention, the fan blades of the heat-dissipating fan 303 are spiral-shaped for better effect of ventilating and heat-dissipating.

The above-mentioned configuration of the heating-dissipating module is very skillful and functions without consuming additional power. It can have excellent heat-dissipating effect in a small internal space of the LED lamp and effectively ensures a longer lifespan for the LED lamp.

The present invention also provides a function for adjusting the LED lamp emitting direction for above-mentioned LED lamp. Thus, in order to achieve this function, the LED lamp further comprises an angle adjusting ring 4 disposed between the LED module 2 and connector 1. Preferably, the angle adjusting ring 4 movably surrounds the connector 1, and is fixed on the LED module 2, so that the LED module 2 is able to rotate along with the angle adjusting ring 4. The angle adjusting ring 4 comprises at least one locking element 41 for fixing the LED module 2 on the connector 1 after the LED module 2 is adjusted to a desired angle. The locking element 41 can be, for example, screws, penetrating the ring body of the angle adjusting ring 4. As the locking element 41 does not press against the standardized connector 1, the angle adjusting ring 4 can rotate relative to the connector 1. Since the locking element 41 is fastened, the angle adjusting ring 4 is immovable on the standardized connector 1.

In addition to above, the LED lamp further comprises an isolating ring 5 disposed between the angle adjusting ring 4 and the standardized connector 1 for avoiding the electrical connection of the angle adjusting ring 4 and the standardized connector 1 as well as any inadvertent touch from the user.

This angle adjusting apparatus allows the LED lamp disclosed by the present invention to have the ability of adjusting emitting direction, compared to the conventional lamps, obviously, the LED lamp disclosed by the present invention can have better illumination effect.

The above-mentioned preferred embodiments are only used as examples for illustrating the present invention. It is understood that various modifications or alterations to the described embodiments for those skilled in the art are intended to be within the spirit and scope of the present invention. The present invention should not be limited in the described embodiments here but should be referred by its claims. The present invention should be understood to cover all aspects of the invention, such as various modifications or equivalent alterations which are not deviated from the scope and spirit of the present invention.

What is claimed is:

1. A light emitting diode (LED) lamp, comprising:

a standardized connector;

an LED module, which is electrically connected to said standardized connector, comprising a circuit board and at least one LED unit which is electrically connected to said circuit board; and a heat dissipating module being in contact with said LED module for heat dissipating, comprising:

at least one heat pipe having a flat segment and a non-flat segment, wherein the LED unit is disposed on the front side of said flat segment of said heat pipe;

a heat dissipating rear shield, connecting said non-flat segment of said heat pipe;

a piston module which is disposed between said heat pipe and said heat dissipating rear shield, and driven by the thermal energy generated by said LED module;

a transmission module connected to said piston module; and a heat-dissipating fan which is disposed in front of the LED lamp, and connected to said piston module by means of said transmission module.

2. The LED lamp according to claim 1, wherein said circuit board is located on the back side of said flat segment of said heat pipe, and said piston module comprises:

a piston cylinder on the back side of said circuit board;

a piston in said piston cylinder; and a piston rod of which one end is attached to said piston, and the other end is attached to said heat dissipating fan by means of said transmission module.

3. The LED lamp according to claim 2, wherein said piston cylinder has a heat conduction portion, and the inner chamber of said piston cylinder is separated into a rear hot chamber and a front cool chamber by said piston, wherein said hot chamber connects to said heat conduction portion.

4. The LED lamp according to claim 3, wherein:

said transmission module comprises a first conical gear, a second conical gear and a connecting rod;

said piston cylinder is mounted longitudinally and oriented forwardly with respect to the direction of the LED lamp, the front end of said piston rod is moveably connected to said first conical gear mounted horizontally by said connecting rod, said first conical gear engages with said second conical gear mounted perpendicularly for transmitting motion; and said heat dissipating fan has a shaft on the back side thereof, which extends into the LED lamp to connect to said second conical gear.

5. The LED lamp according to claim 4, wherein said circuit board has a through hole, and said heat dissipating module further comprises a convection fan which is placed in said through hole and connected to said second conical gear by a shaft of the convection fan.

6. The LED lamp according to claim 2, wherein said heat conduction portion can be a power transistor or other components in which heat is difficult to dissipate.

7. The LED lamp according to claim 6, wherein:

said transmission module comprises a first conical gear, a second conical gear and a connecting rod;

said piston cylinder is mounted longitudinally and oriented forwardly with respect to the direction of the LED lamp, the front end of said piston rod is moveably connected to said first conical gear mounted horizontally by said connecting rod, said first conical gear engages with said second conical gear mounted perpendicularly for transmitting motion; and said heat dissipating fan has a shaft on the back side thereof, which extends into the LED lamp to connect to said second conical gear.

8. The LED lamp according to claim 7, wherein said circuit board has a through hole, and said heat dissipating module further comprises a convection fan which is placed in said through hole and connected to said second conical gear by a shaft of the convection fan.

9. The LED lamp according to claim 2, wherein:

said transmission module comprises a first conical gear, a second conical gear and a connecting rod;

said piston cylinder is mounted longitudinally and oriented forwardly with respect to the direction of the LED lamp, the front end of said piston rod is moveably connected to said first conical gear mounted horizontally by said connecting rod, said first conical gear engages with said second conical gear mounted perpendicularly for transmitting motion; and said heat dissipating fan has a shaft on the back side thereof, which extends into the LED lamp to connect to said second conical gear.

10. The LED lamp according to claim 9, wherein said circuit board has a through hole, and said heat dissipating module further comprises a convection fan which is placed in said through hole and connected to said second conical gear by a shaft of the convection fan.

11. The LED lamp according to claim 1, said heat dissipating fan has at least one spiral-shaped blade.

12. The LED lamp according to claim 1, wherein said heat-dissipating rear shield comprises a plurality of fins.

13. The LED lamp according to claim 1, further comprises an angle adjusting ring disposed between said LED module and the standardized connector for rotating the LED module so as to change a light emitting direction of the at least one LED unit, wherein the angle adjusting ring comprises at least one locking element for fixing the LED module on the connector after rotated to a required direction, the LED lamp further comprises an isolating ring disposed between the angle adjusting ring and the standardized connector for avoiding the electrical connection of the angle adjusting ring and the standardized connector.

14. An LED lamp, comprising:

a standardized connector;

an LED module, which is electrically connected to said standardized connector, comprising a circuit board and at least one LED unit which is electrically connected to said circuit board; and a heat dissipating module being in contact with said LED module for heat dissipating, comprising:

at least one heat pipe having a flat segment and a non-flat segment, wherein the LED unit is disposed on the front side of said flat segment of said heat pipe;

a heat dissipating rear shield, connecting to said non-flat segment of said heat pipe;

a piston module which is disposed between said heat pipe and said heat dissipating rear shield, and driven by the thermal energy generated by said LED module;

a transmission module connected to said piston module;

a heat-dissipating fan which is disposed in front of the LED lamp, and connected to said piston module by means of said transmission module; and said circuit board is located on the back side of said flat segment of said heat pipe, and said piston module comprises:

a piston cylinder on the back side of said circuit board;

a piston in said piston cylinder;

a piston rod of which one end is attached to said piston, and the other end is attached to said heat dissipating fan by means of said transmission module;

said transmission module comprises a first conical gear, a second conical gear and a connecting rod, said piston cylinder is mounted longitudinally and oriented forwardly with respect to the direction of the LED lamp, the front end of said piston rod is moveably connected to said first conical gear mounted horizontally by said connecting rod, said first conical gear engages with said second conical gear mounted perpendicularly for transmitting motion; and said heat dissipating fan has a shaft on the back side thereof, which extends into the LED lamp to connect to said second conical gear.

15. The LED lamp according to claim 14, wherein said circuit board has a through hole, and said heat dissipating module further comprises a convection fan which is placed in said through hole and connected to said piston rod by a shaft of the convection fan.

16. The LED lamp according to claim 14, wherein said piston cylinder has a heat conduction portion, and the inner chamber of said piston cylinder is separated into a rear hot chamber and a front cool chamber by said piston, wherein said hot chamber connects to said heat conduction portion.

17. The LED lamp according to claim 14, wherein said heat conduction portion can be a power transistor or other components in which heat is difficult to dissipate.

18. The LED lamp according to claim 14, wherein said heat dissipating fan has at least one spiral-shaped blade.

19. The LED lamp according to claim 14, wherein said heat-dissipating rear shield comprises a plurality of fins.

20. The LED lamp according to claim 14, further comprises an angle adjusting ring disposed between said LED module and the standardized connector for rotating the LED module so as to change a light emitting direction of the at least one LED unit, wherein the angle adjusting ring comprises at least one locking element for fixing the LED module on the connector after rotated to a required direction, the LED lamp further comprises an isolating ring disposed between the angle adjusting ring and the standardized connector for avoiding the electrical connection of the angle adjusting ring and the standardized connector.

* * * * *